United States Patent [19]

Roemer

[11] Patent Number: 4,886,128

[45] Date of Patent: Dec. 12, 1989

[54] RAM BORING IMPLEMENT HAVING A MOVABLE BIT

[76] Inventor: Helmuth Roemer, Attendorner Str. 135, 5950 Finnentrop-Heggen, Fed. Rep. of Germany

[21] Appl. No.: 173,783

[22] Filed: Mar. 28, 1988

[30] Foreign Application Priority Data

Mar. 27, 1987 [DE] Fed. Rep. of Germany ..... 3710162

[51] Int. Cl.[4] ..... E21B 4/14

[52] U.S. Cl. ..... 175/19; 173/91; 173/132; 173/133; 173/136; 175/92; 175/296

[58] Field of Search ..... 175/19, 92, 296; 173/91, 132, 133, 136, 137, 138, 139

[56] References Cited

U.S. PATENT DOCUMENTS

| | | | |
|---|---|---|---|
| 450,782 | 4/1891 | Laun | 173/136 X |
| 520,915 | 6/1894 | Clouteau | 173/136 |
| 1,416,086 | 5/1922 | Wolfe | 173/133 X |
| 1,665,046 | 4/1928 | Tucker | 173/136 X |
| 3,266,581 | 8/1966 | Cooley et al. | 173/138 X |
| 3,865,200 | 2/1975 | Schmidt | 173/133 X |
| 4,018,291 | 4/1977 | Anderson | 173/139 X |
| 4,366,868 | 1/1983 | Salmi | 173/132 X |
| 4,624,325 | 11/1986 | Steiner | 173/139 |

FOREIGN PATENT DOCUMENTS

| | | | |
|---|---|---|---|
| 238665 | 6/1964 | Austria | 173/132 |
| 2157259 | 6/1973 | Fed. Rep. of Germany . | |
| 3124524 | 1/1983 | Fed. Rep. of Germany . | |
| 8310178.0 | 10/1983 | Fed. Rep. of Germany . | |

*Primary Examiner*—Hoang C. Dang

*Attorney, Agent, or Firm*—Foley & Lardner, Schwartz, Jeffery, Schwaab, Mack, Blumenthal & Evans

[57] ABSTRACT

A ram boring implement having a pneumatically or hydraulically driven percussion piston, movable axially in a reciprocating manner in a housing, and an axially movable bit which is connected to an end of the housing and acted upon directly or indirectly by the percussion piston, is of a structure which permits a restoring piston, connected to the bit, to be acted upon by the pneumatic or hydraulic pressure during the return stroke of the percussion piston.

14 Claims, 3 Drawing Sheets

RAM BORING IMPLEMENT HAVING A MOVABLE BIT

BACKGROUND OF THE INVENTION

The invention relates to a ram boring implement having a pneumatically or hydraulically driven percussion piston, movable in a reciprocating manner in a housing in the axial direction, and an axially movable bit which is arranged on the front end of the housing and is acted upon directly or indirectly by the percussion piston.

Ram boring implements of this type are used for driving earth bores for cables and the like to be laid underground. The bit is used to shatter and displace the earth. The movable arrangement of the bit offers the advantage that the percussion energy of the percussion piston can first be specifically transferred to the bit so that greater shattering energy is available.

German Patent Specification No. 2,157,259 discloses a ram boring implement of the above-mentioned type, in which the bit acted upon directly by the percussion piston or by an intermediate piston is pretensioned elastically into its rear end position by means of a spring supported on the housing. This has the disadvantage that a portion of the percussion energy is absorbed by the restoring spring during each blow. Moreover, if no resistance is offered to the bit, this results in the disadvantage that the bit constantly executes idle blows during which it reaches very high speeds which may result in damage to the implement.

German Patent Specification No. 3,124,524 describes a ram boring implement in which the bit is elastically pretensioned into a front end position in which it is not struck by the percussion piston. If no resistance or only a slight resistance is offered to the bit, the percussion energy is therefore directly transferred to the housing, and only if the bit strikes an obstacle and is thrust back into the housing is it struck by the percussion piston so that the obstacle is shattered. In this arrangement, although damaging idle blows are avoided, a portion of the percussion energy is used up here too by the spring, since the housing has to be accelerated forward against the spring force when the bit located in the front end position strikes an obstacle. Moreover, in loose soil, where the housing is only slightly supported in the earth, there is the risk of the housing being thrust back by the bit, supported at the front, and the pretensioned spring.

German Utility Model No. 8,310,178 discloses a ram boring implement in which the bit is mounted in a freely movable manner in the front part of the housing and is separated from the percussion piston by a housing wall. Here, the percussion energy is transferred to the bit by an impulse blow imparted by the housing. However, this has the disadvantage that a portion of the percussion energy is inelastically absorbed by the housing during the impulse blow if the bit does not bear against the housing wall during the initial phase of the blow. In stony soil formations, therefore, there is often not enough shattering energy available.

SUMMARY OF THE INVENTION

It is therefore an object of the present invention to create a ram boring implement of the generic type mentioned above in which less energy losses occur during the transfer of the percussion energy to the bit and in which the bit can be conveyed into a defined end position after the blow.

This object is achieved according to the present invention by providing a ram boring implement comprising a housing having a fluid driven percussion piston reciprocally movable axially within the housing. An axially movable bit is connected to one end of the housing. The bit includes a restoring piston extending into the housing. The bit is movable in direct and in fluid contact with the percussion piston.

According to the invention, the pressure which serves to drive the percussion piston in the return direction is thus at the same time utilized for resetting the bit. Since this pressure does not build up until the start of the return stroke of the percussion piston, no corresponding counterpressure has to be overcome during the forward stroke of the percussion piston so that the percussion energy can be transferred undiminished to the bit.

The restoring piston is preferably arranged in such way in a restoring chamber which receives the pneumatic or hydraulic pressure that it resets the bit into its rear end position.

In a modified embodiment of the invention, however, the rear end face of the restoring piston can also be acted upon by pressure so that the bit is thrust forward and is not acted upon by the percussion piston as long as the earth only puts up a slight resistance to the bit.

In the preferred embodiment, in which the bit is reset pneumatically into the rear end position, repeated idle blows of the bit can be avoided by the pressure supply to the restoring piston being interrupted by a valve arrangement when the bit is driven very far forward during the blow.

Since, according to the invention, the bit does not need to be supported by a spring, the bit can execute a rotary motion with respect to the housing. In an advantageous refinement of the invention, the tip of the bit is therefore profiled in such a way that the bit turns easily when penetrating into the earth. The shattering performance of the bit is thereby improved and the directional stability of the ram boring implement increased.

Further objects, features and advantages of the invention will become apparent from the detailed description of the preferred embodiments that follows, when considered in light of the accompanying figures of drawings.

BRIEF DESCRIPTION OF THE DRAWINGS

In the drawings.

FIG, 2 illustrates an enlarged section through the front end of an embodiment of the ram boring implement with a bit located in the rear position.

BRIEF DESCRIPTION OF PREFERRED EMBODIMENTS

Figure 1:
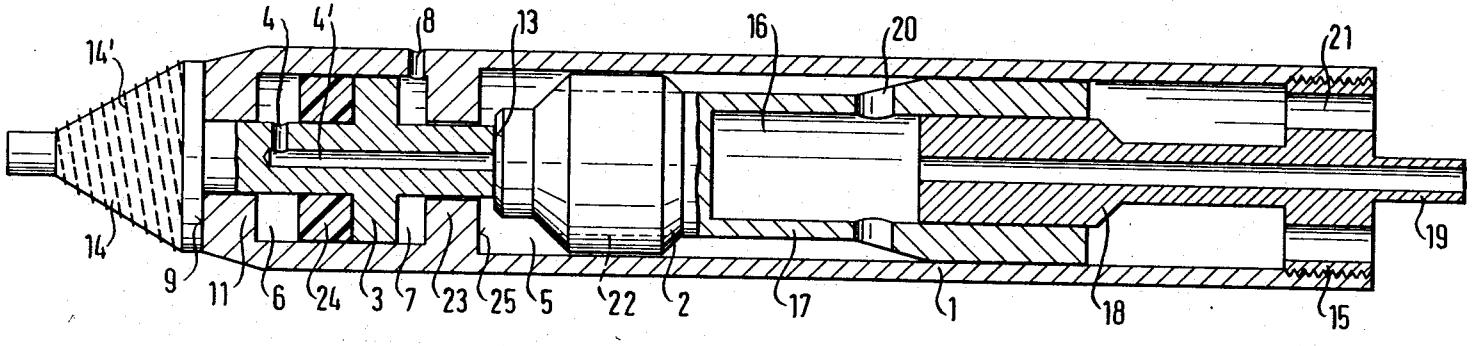
FIG. 1 illustrates a longitudinal section through an embodiment of a ram boring implement.

According to FIG. 1, the ram boring implement has a housing 1 which is provided with a bit 14 having a helical profiling 14' and is closed at the rear end by an end piece 15. A front drive-pressure chamber 5 is formed inside the housing 1 by a percussion piston 2 guided in an axially movable manner in the housing. A rear drive-pressure chamber 16 is located in a tubular section 17 of the percussion piston 2 which is displaceable in a sliding manner on a control sleeve 18. A hose 19 supplies the ram boring implement with compressed air. The tubular section 17 of the percussion system 2 is provided with radial channels 20, and the end piece has axial air channels 21.

In the position of the percussion piston 2 shown in FIG. 1, the compressed air introduced through the hose 19 passes through the radial channels 20 and through axial channels 22 of the percussion piston into the front drive-pressure chamber 5 so that a high pressure prevails in this drive-pressure chamber.

Since the effective area of the percussion piston 2 relative to the front drive-pressure chamber 5 is greater than relative to the rear drive-pressure chamber 16, the piston is thrust rearward.

During the return motion of the percussion piston, the radial channels 20 are temporarily closed by the control sleeve 18. As soon as these radial channels slide away over the rear end of the control sleeve, the pressure in the front drive-pressure chamber 5 can be relieved via the channels 22, 20 of the percussion piston and the axial air channels 21 of the end piece 15, so that the percussion piston is driven forward again by the pressure prevailing in the rear drive-pressure chamber 16. At the end of the forward stroke, the percussion piston 2 strikes the rear end face 13 of the bit 14 without deceleration, so that the bit is driven into the earth.

The part of the bit 14 located inside the housing 1 extends gastight through a front end wall 11 of the housing and a dividing wall 23 which bounds the front drive-pressure chamber 5. The section of the bit located between the end wall 11 and the dividing wall 23 forms a restoring piston 3 whose front end face is surrounded by a cushioning element 24 and which, with the peripheral wall and the front end wall of the housing, defines a restoring chamber 6. The space between the restoring piston 3 and the dividing wall 23 is ventilated through a bore 8 of the housing 1. The restoring chamber 6 is connected to the front drive-pressure chamber 5 via a radial channel or bore 4 and an axial channel or bore 4' of the bit.

Figure 2:
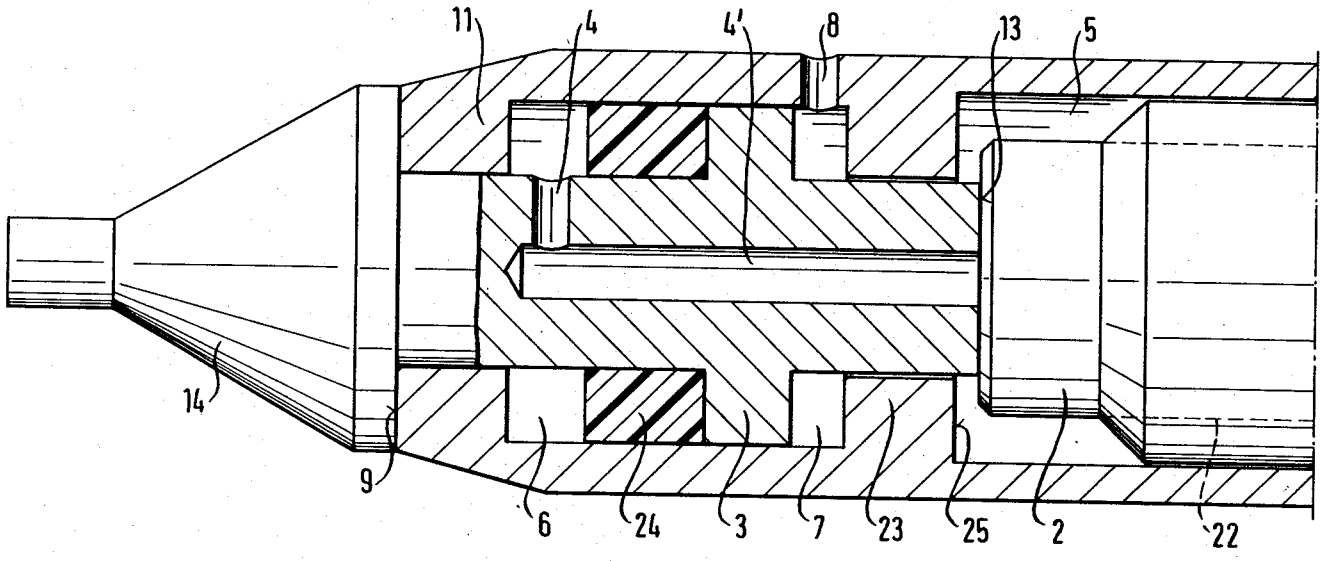

If the earth puts up a high resistance to the bit 14, the bit, acted upon by the percussion piston 2, moves only a relatively short distance forward with respect to the housing so that the radial bore 4 remains inside the restoring chamber 6. The pressure prevailing in the front drive-pressure chamber 5 during the return stroke of the percussion piston 2 therefore spreads via the axial channel 4' and the radial channel 4 into the restoring chamber 6. Since the effective area of the restoring piston 3 facing the restoring chamber 6 is greater than the rear end face 13 of the bit exposed to the front drive chamber 5, the bit is set back pneumatically into the rear end position, shown in FIGS. 1 and 2, in which the conically widened head of the bit strikes against the front end face 9 of the end wall 11.

If the earth offers a smaller resistance, the bit can be driven further into the earth so that the percussion piston 2, with its front end, strikes against the rear end face 25 of the dividing wall 23. In this way, a portion of the percussion energy is utilized for driving the housing.

Figure 3:
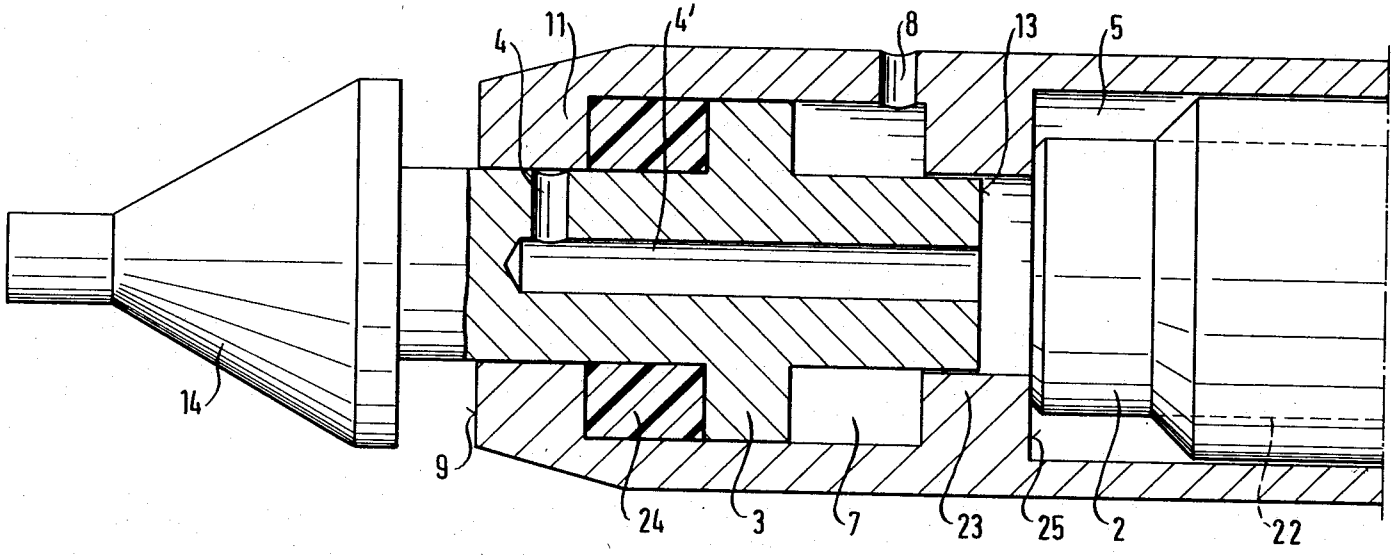
FIG. 3 illustrates a section similar to FIG. 2, but in which the bit is located in the front position.

If the earth offers a very small resistance, the bit 14 moves so far forward that the radial bore 4 is closed by the end wall 11 of the housing, as shown in FIG. 3. The impact of the bit in the front end position is dampened by the cushioning element 24.

In the position shown in FIG. 3, no pressure can build up in the restoring chamber 6. Only the rear end face I3 of the bit is acted upon by the pressure prevailing in the front drive-pressure chamber 5, so that the bit remains in the front end position. In this way, undesirable idle blows of the bit are avoided.

As can be seen in FIG. 3, the bit in the front end position is not struck by the percussion piston 2 so that the entire percussion energy is available for driving the housing. Only when the bit 14 meets greater resistance again and is thrust back into the housing 1 does the radial bore 4 again come into fluid connection with the restoring chamber 6 so that the bit, during the return stroke of the percussion piston, is again conveyed into the rear end position.

What is claimed is:

1. A ram boring implement for driving earth bores comprising:
   - a housing;
   - a control sleeve disposed within said housing, means for securing said control sleeve to said housing, said securing means having at least one opening extending therethrough to allow fluid communication between the interior and the exterior of said housing;
   - a fluid driven percussion piston reciprocally movable axially on the control sleeve within said housing;
   - an axially movable bit connected to one end of said housing, said bit being directly or indirectly acted upon by the percussion piston in response to resistance acting against the bit;
   - a restoring piston being connected to the bit; and
   - means for subjecting a side of said restoring piston which is remote from the percussion piston to fluid pressure produced during a rearward stroke of the percussion piston.

2. The ram boring implement of claim 1 including:
   - means for forming a drive-pressure chamber in the housing, said percussion piston being in said drive-pressure chamber; and
   - means for forming a restoring chamber in and adjacent to one end of the housing, said restoring piston being in said restoring chamber, said restoring chamber being in fluid communication with said drive-pressure chamber.

3. The ram boring implement of claim 2, wherein said fluid communication between said restoring and drive-pressure chambers is interrupted in response to movement of said bit.

4. The ram boring implement of claim 2, wherein said bit and said restoring piston are of a one-piece construction, said restoring piston having a portion thereof protruding into said drive-pressure chamber for direct contact with said percussion piston.

5. The ram boring implement of claim 2, including:
   - axial channel means for fluidly interconnecting said drive-pressure chamber and said restoring chamber, said axial channel means extending through said restoring piston, said axial channel means being closed in response to said bit being in direct contact with said percussion piston.

6. The ram boring implement of claim 5 including:
   - radial channel means for fluidly interconnecting said drive-pressure chamber and said restoring chamber, said radial channel means being fluidly connected to said axial channel means, said radial channel means being closed by an endwall portion of said housing in response to movement of said restoring piston.

7. The ram boring implement of claim 6 including:

a dividing wall formed in said housing between said drive-pressure chamber and said restoring chamber, said percussion piston being movable into contact with a portion of said dividing wall.

8. The ram boring implement of claim 7, wherein said bit is movable to a position wherein said radial channel means is closed by said endwall simultaneously with said percussion piston being limited from direct contact with said bit by said dividing wall.

9. The ram boring implement of claim 6 including:

resilient means for damping movement of said restoring piston, said resilient means being between said endwall portion and said restoring piston.

10. The ram boring implement of claim 1, wherein said bit is rotatably connected to said housing and includes helical profiling on an earth-penetrating outer surface thereof.

11. A ram boring implement for driving earth bores comprising:

a housing having an endwall, a dividing wall, a restoring chamber and a drive-pressure chamber therein, said dividing wall separating the restoring chamber and the drive-pressure chamber, a control sleeve disposed within said housing, means for securing said control sleeve to said housing, said securing means having at least one opening extending therethrough to allow fluid communication between the interior and the exterior of said housing;

a fluid driven percussion piston reciprocally movable axially on said control sleeve within said drive-pressure chamber, movement of said percussion piston being limited by said dividing wall;

an axially movable bit connected to one end of said housing, said bit being directly and indirectly acted upon by the percussion piston in response to resistance acting against the bit;

means for preventing direct contact of the percussion piston upon the bit, which means is responsive to resistance acting against the bit;

a restoring piston being connected to the bit; and means for fluidly connecting a portion of said restoring chamber to said drive-pressure chamber during a rearward stroke of the percussion piston, the portion of the restoring chamber being on a side of the restoring piston remote from the percussion piston.

12. The ram boring implement of claim 11 including:

channel means extending through said restoring piston for fluidly interconnecting said drive-pressure chamber and said restoring chamber.

13. The ram boring implement of claim 12 including:

resilient means for damping movement of said restoring piston.

14. A ram boring implement for driving earth bores comprising:

a housing;

a control sleeve disposed within said housing, means for securing said control sleeve to said housing, said securing means having at least one opening extending therethrough to allow fluid communication between the interior and the exterior of said housing;

a fluid driven percussion piston reciprocally movable axially on the control sleeve within said housing;

an axially movable bit connected to one end of said housing, said bit being directly acted upon by the percussion piston in response to a first resistance acting against the bit and being indirectly acted upon by the percussion piston in response to a second resistance, greater than said first resistance, acting against the bit;

a restoring piston being connected to the bit; and means for subjecting a side of said restoring piston which is remote from the percussion piston to fluid pressure produced during a rearward stroke of the percussion piston.

* * * * *